United States Patent [19]

LeStrange

[11] 4,175,970

[45] Nov. 27, 1979

[54] PROCESS FOR SENSITIZING PHOTOGRAPHIC SILVER HALIDE EMULSIONS

[75] Inventor: Raymond J. LeStrange, Hendersonville, N.C.

[73] Assignee: E. I. Du Pont de Nemours and Company, Wilmington, Del.

[21] Appl. No.: 927,050

[22] Filed: Jul. 24, 1978

[51] Int. Cl.[2] ..... G03C 1/78; G03C 1/28

[52] U.S. Cl. ..... 430/529; 430/603; 430/619; 430/621

[58] Field of Search ..... 96/107, 94 R, 108, 111, 96/109, 67, 87 R

[56] References Cited

U.S. PATENT DOCUMENTS

| | | | |
|---|---|---|---|
| 3,232,764 | 2/1966 | Allen et al. | 96/111 |
| 4,124,397 | 11/1978 | Abele et al. | 96/111 |

*Primary Examiner*—Won H. Louie, Jr.

[57] ABSTRACT

A process for sensitizing photographic gelatino-silver halide emulsions with glutaraldehyde bisulfite in combination with benzene sulfinic acid.

9 Claims, 1 Drawing Figure

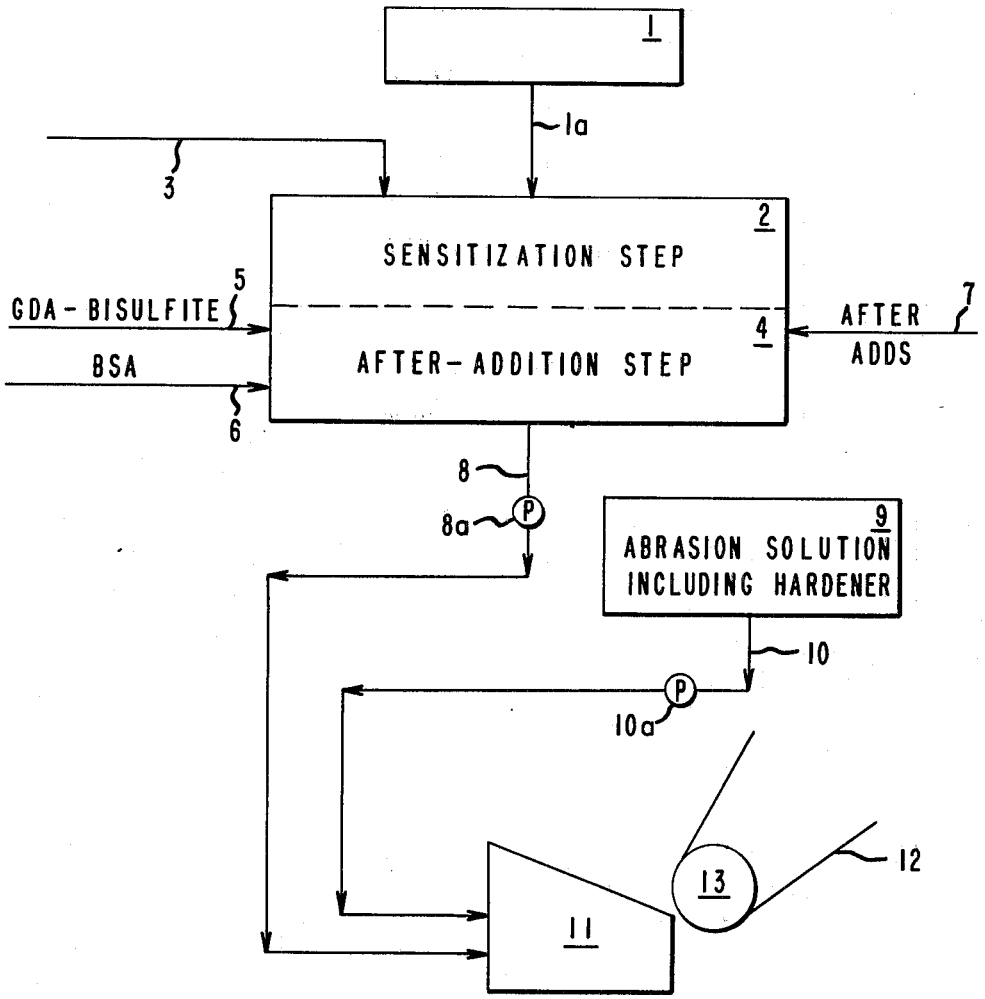
1
1a
3
2
SENSITIZATION STEP
5
GDA-BISULFITE
4
AFTER ADDS
7
BSA
AFTER-ADDITION STEP
6
8
8a
P
9
ABRASION SOLUTION INCLUDING HARDENER
10
P
10a
12
13
11

PROCESS FOR SENSITIZING PHOTOGRAPHIC SILVER HALIDE EMULSIONS

DESCRIPTION

1. Technical Field

This invention relates to the sensitization of photographic gelatino-silver halide emulsions.

2. Background Art

It is known that dialdehydes are effective hardeners when used in photographic gelatino-silver halide emulsions. U.S. Pat. No. 3,232,764 and Re. No. 26,601 disclose dialdehydes, the aldehyde groups of which are separated by an unbranched chain of 2–3 carbon atoms, preferably glutaraldehyde and its derivatives. These include the alkali-metal bisulfite addition product, hereafter the bisulfite. These patents further state that to attain the desired hardening effect it is necessary to use the dialdehyde, or its bisulfite, in a concentration of at least 0.5 to 25% by weight of the gelatin content.

A copending application of Abele et al, Ser. No. 836,840, filed Sept. 23, 1977, now U.S. Pat. No. 4,124,397, "Process For Hardening Photographic Silver Halide Emulsions", describes an improved process for hardening photographic gelatino-silver halide emulsions using glutaraldehyde or substituted glutaraldehyde as the hardener, singly or in combination with an aliphatic or aromatic sulfinic acid or salt thereof. In that process the concentration of the glutaraldehyde hardener is less than 0.5% by weight, based on the weight of the total gelatin content, and a combination of good hardening effects and improved sensitometric properties is attained. However, that process requires so-called "in-line" injection equipment in order to add the hardener continuously to the emulsion stream at a point between the supply vessel and the coater, and immediately prior to the coating process. The injection equipment is complicated and difficult to maintain in operative condition. When faults occur in the operation of the equipment the addition of hardener is interrupted. This interruption cannot be easily detected. Hence, many square feet of film may be coated before such interruption is discovered. Film coated without hardener must be scrapped, a result which cannot be tolerated over long periods of time.

The present invention uses some of the teachings in the art described above, but in a way which attains a new and different result, one which gives sensitization without hardening and does not require special "in-line" equipment; it also permits the use of lower concentrations of the dialdehyde than those required by the prior art.

BRIEF DESCRIPTION OF DRAWING

The accompanying FIGURE, forming a material part of this disclosure, is a flow sheet illustrating the process of this invention.

DISCLOSURE OF INVENTION

The present invention is a process for the sensitization of a gelatino-silver halide emulsion using small amounts (e.g., 0.1 to 0.3% by weight, based on the weight of gelatin present) of glutaraldehyde (GDA) bisulfite or substituted glutaraldehyde bisulfite in combination with a sulfinic acid, e.g., benzene sulfinic acid or toluene sulfinic acid. This combination is added to the gelatino-silver halide emulsion prior to coating the latter upon a film support. The concentration of GDA-bisulfite in the emulsion is too low to effect any significant degree of hardening of the emulsion, but rather its effect is to significantly increase the sensitivity of the emulsion with little or no increase in fog. Conventional hardeners, such as formaldehyde, are added either directly to the gelatino-silver halide emulsion prior to coating, or are added to an abrasion layer which is coated over the gelatino-silver halide emulsion. In the latter case the hardener migrates into the emulsion layer and subsequently hardens the emulsion. The GDA-bisulfite combination appears to react as a true sensitization system for the gelatino-silver halide emulsion.

Bisulfites of the following dialdehydes are suitable for use in practicing the process of this invention:

glutaraldehyde
2-methyl-glutaraldehyde
3-methyl-glutaraldehyde
2,2'-dimethyl-glutaraldehyde
2-N-butoxy-glutaraldehyde
3-N-butoxy-glutaraldehyde
2-methyl-3-ethoxy-glutaraldehyde
2-ethyl-3-ethoxy-glutaraldehyde Referring to the drawing, a gelatino-silver halide emulsion is precipitated in conventional manner in supply vessel 1, and a stream of this emulsion is discharged through line 1*a* into another vessel represented by 2,4. Chemical sensitizers, e.g., gold and sulfur compounds are then added from line 3 and the emulsions sensitized by mixing these components at elevated temperatures for the specified period of time. This sensitization step is labeled 2 on the drawing. The emulsion is then cooled and the additives of this invention, e.g., GDA-bisulfite and benzene sulfinic acid (BSA), or its sodium salt, are injected through lines 5, 6. Usually these components are added in an aqueous solution to insure proper mixing in the emulsion.

It is preferable to add the GDA-bisulfite solution in an amount of 0.1 to 0.3 percent by weight, based on the weight of gelatin in the gelatino-silver halide emulsion present. Benzene sulfinic acid, toluene sulfinic acid, or other substituted aromatic sulfinic acid or salt, is added in concentrations of 0.5 to 15 g of aromatic sulfinic acid salt per mole of silver halide, but preferably 1 to 6 g of the sulfinic acid is added per mole of silver halide. Other so-called "after-adds" consisting of conventional antifoggants, stabilizers, wetting agents, coating aids, and the like are usually added at this step and are represented by line 7. The overall addition of GDA-bisulfite, BSA, and "after-adds" is collectively labeled as step 4 on the drawing.

It should be noted that both sensitization (step 2) and after-addition (step 4) are usually carried out in the same vessel. Hence, the dotted line between 2 and 4 on the drawing indicates the separation of steps, not two vessels.

The mixture prepared as described above is stable and can be cooled and stored for some period of time. Eventually, this prepared emulsion is pumped through line 8 by pump 8*a* to coating station 11. In preparation for the application of a so-called abrasion coating (a protective coating applied over the silver halide emulsion coating), an "abrasion solution" is prepared from gelatin, water, coating aids, etc. in a separate vessel 9. A hardener, such as formaldehyde, is added to this abrasion solution. The latter is then pumped through line 10 by pump 10*a* to coating station 11. Here the emulsion is coated on film base 12 which is moving over roller 13, and thereafter the abrasion layer is coated directly on the gelatino-silver halide emulsion layer. In this process the emulsion hardens over a period of time as the hardener migrates down from the abrasion layer to the emulsion layer. This is the conventional method of hardening X-ray film. When coating other black and white film elements it is conventional to add the hardening agent to the emulsion formulation just prior to coating.

The photographic layers and other layers of the photographic element described herein can be coated on a wide variety of supports. Typical supports include cellulose nitrate film, poly(ethylene terephthalate)film, polycarbonate film, and related films or resinous materials, as well as glass, paper, metal and the like.

In place of glutaraldehyde bisulfite or substituted glutaraldehyde bisulfite it is possible to use succinaldehyde bisulfite, and in place of using formaldehyde as the hardener other suitable hardeners could be employed, such as glyoxal, muochloric acid, chrome alum, and the like.

The process of the invention is suitable for sensitizing all usual gelatin-containing light-sensitive emulsions, such as silver chloride, silver bromide, silver chlorobromide, or silver bromoiodide emulsions. The emulsions can contain the usual additives, such as optical sensitizers, coating additives, wetting agents, antifoggants, etc.

There appears to be a synergistic effect resulting from the combination of the GDA-bisulfite and benzene sulfinic acid (BSA). An important advantage of this process is that both GDA-bisulfite and BSA may be added to the emulsion in a conventional manner, and the resulting emulsion held in molten condition for extended periods of time without detriment to its use as a coating composition. It does not set up or harden, even though GDA-bisulfite is a known hardening agent, because the amounts of these which are added are insufficient to cause hardening. This makes it possible to keep the mixture, shown in the drawing as after-addition step 4, in storage, if desired, before passing it to the coater, and it makes it unnecessary to use so-called "in-line" injection equipment. In other words, the over-all process can be either a continuous process or a batch process.

The process is illustrated by the following Examples, of which Example 1 constitutes the best mode.

EXAMPLE 1

A coarse grained gelatino-silver iodobromide emulsion of the type used in medical X-ray films was prepared. This emulsion contained ca. 98 mole % AgBr and ca. 2 mole % AgI with about 5 weight % of gelatin and about 10 weight % of the silver halide. The emulsion was sensitized by digestion with sodium thiocyanate and gold thiocyanate and then the usual antifoggants, coating aids, and wetting aids were added. At this point, the emulsion was divided into three (3) parts. Part A (the Control) was coated on a 0.007 inch (0.018 cm.) thick biaxially oriented and heat-relaxed poly(ethylene terephthalate) film support which contained a blue dye to integrally tint the support. The latter had been subbed on each side with a conventional resin subbing layer (e.g., a vinylidene chloride/methyl acrylate/itaconic acid copolymer mixed with a methyl acrylate polymer), over which a thin anchoring substratum of gelatin had been coated (about 0.5 mg/dm$^2$). The emulsion was applied on one side to a thickness of about 60 mg/dm$^2$ of silver bromide, and a 10 mg/dm$^2$ abrasion layer of gelatin containing formaldehyde hardener was applied on top of the silver halide layer.

Part B was modified before coating by adding an aqueous solution of glutaraldehyde and sodium benzene sulfinate thereto, so that the final emulsion solution contained about 0.08% by weight (based on gelatin) of glutaraldehyde and about 2% by weight of sodium benzene sulfinate (based on silver halide).

Part C was modified according to the invention by adding thereto an aqueous solution of GDA-bisulfite and sodium benzene sulfinate prior to coating, so that the final emulsion solution contained about 0.23% by weight (equivalent to 0.08% by weight of glutaraldehyde) of GDA-bisulfite (based on gelatin) and about 2% by weight of the sodium benzene sulfinate (based on silver halide).

Sample strips (35 mm) from each of the dried coatings were placed back to back (e.g., to simulate double-side coated material) in an X-ray cassette along with a pair of calcium tungstate X-ray screens so that the emulsion sides faced the X-ray screens. These samples were given an X-ray exposure at 70 kVp, 20 ma for 2 seconds, at a distance of 40 inches (101.6 cm.), through a $\sqrt{2}$ aluminum step wedge using a Buckey grid. Each of the exposed samples was processed in an X-ray strip machine using the following developer solution:

| | |
|---|---|
| Hydroquinone | 30 g |
| 1-phenyl-3-pyrazolidone | 1 g |
| $Na_2SO_3$ (anh.) | 60 g |
| KOH | 23 g |
| $NaBO_2 . 4H_2O$ | 20 g |
| KBr | 4 g |
| 1-phenyl-5-mercaptotetrazole | 0.015 g |
| Distilled Water to | 1 liter |

The film samples were fixed, washed and dried and the following results were obtained:

| Sample | Additives | Amt. Used (% by Wt.) | Rel Speed | Base +Fog | Melting Point(1) |
|---|---|---|---|---|---|
| A | None - Control | — | 100 | 0.19 | 80° C. |
| B | Glutaraldehyde | 0.08(2) | 106 | 0.30 | 80° C. |
| | Na-benzene sulfinate | 2.0(3) | | | |
| C | Glutaraldehyde bisulfite | 0.23(2) | 115 | 0.19 | 80° C. |
| | Na-benzene sulfinate | 2.0(3) | | | |

(1)Melting point of emulsion taken in water
(2)Based on gelatin
(3)Based on silver halide These results demonstrate the improved sensitometric effect when the GDA-bisulfite is used. Since the melting point is the same in all cases, insufficient glutaraldehyde is present to effect normal hardening.

EXAMPLE 2

An emulsion similar to that described in Example 1 was prepared, sensitized and divided into four (4) parts. Each part contained the usual after-additions (e.g., wetting/coating aids, antifoggants, etc.) annd further contained the following added as described in Example 1:

| Sample | Additive | Amount (% Based on Gelatin |
|---|---|---|
| A-Control | none | — |
| B- | Glutaraldehyde (GDA)(1) | 0.08 |
| C- | Glutaraldehyde bisulfite | |

-continued

| Sample | Additive | Amount (% Based on Gelatin |
|---|---|---|
| | (GDABS)[1] | 0.23 |
| D- | 3-methyl-glutaraldehyde bisulfite[1] (m-GDABS) | 0.23 |

[1]Sodium benzene sulfinate was added in the amount of 2% by weight, based on the weight of AgX in the emulsion The four emulsions were each coated on polyester film as described in Example 1 and samples from each coating were exposed and developed as described therein with the following results:

| Sample | Relative Speed | Base + Fog |
|---|---|---|
| A-Control | 100 | 0.17 |
| B-GDA | 107 | 0.20 |
| C-GDABS | 128 | 0.17 |
| D-m-GDABS | 120 | 0.17 |

EXAMPLE 3

An emulsion similar to that described in Example 1 was prepared and split into three (3) portions. Portion A (the Control) was coated on a poly(ethylene terephthalate) film support without further treatment. Portion B was mixed with an aqueous GDABS solution (0.30 weight % based on gelatin). Portion C was mixed with an aqueous GDABS solution (same amount) plus sodium benzene sulfinate, 2% by weight based on silver halide). Portions B and C were then coated on appropriate film supports. Samples from each coating were exposed and developed as previously described with the following results:

| Sample | Relative Speed | Base + Fog |
|---|---|---|
| A-Control | 100 | 0.17 |
| B-GDABS | 122 | 0.21 |
| C-GDASBS + Na-benzene sulfinate | 143 | 0.17 |

EXAMPLE 4

An emulsion similar to that described in Example 1 was prepared and divided into three (3) portions. Portion A (the Control) was coated on a poly(ethylene terephthalate) film support without further treatment. Aqueous GDABS was added to each of the other portions (B and C) at a level of 0.23% by weight based on gelatin contained therein. Sodium benzene sulfinate was added to Portion B (2% by weight based on silver halide) and sodium toluene sulfinate to Portion C (2.5% by weight). Both B and C were then coated on appropriate film supports and samples from all coatings were exposed and developed as described in Example 1 with the following results:

| Sample | Relative Speed | Base + Fog |
|---|---|---|
| A-Control | 100 | 0.31 |
| B-with Na-benzene sulfinate | 120 | 0.31 |
| C-with Na-toluene sulfinate | 123 | 0.31 |

I claim:

1. A process for the sensitization of a light-sensitive gelatino-silver halide emulsion prior to coating it upon a support, in which process the gelatino-silver halide emulsion is made up in a supply vessel and subsequently introduced into a coater for application to a film support, the improvement which comprises adding to the emulsion in the supply vessel (1) either glutaraldehyde bisulfite, succinaldehyde bisulfite, or a substituted glutaraldehyde bisulfite, in a concentration of between 0.05 and 0.3% by weight, based on the weight of total gelatin in the emulsion, and (2) an aromatic sulfinic acid, or a water-soluble salt thereof, in a concentration of 0.5 to 15 grams per mole of silver halide in the emulsion.

2. Process of claim 1 wherein an aromatic sulfinic acid (2) is added to the emulsion in a concentration of 1-6 g/mole of silver halide in the emulsion.

3. Process of claim 1 wherein the aromatic sulfinic acid is benzene sulfinic acid or toluene sulfinic acid.

4. Process of claim 1 wherein the aromatic sulfinic acid is added in the form of an alkali metal salt.

5. Process of claim 1 wherein a gold or sulfur sensitizer is added to the emulsion in the supply vessel.

6. Process of claim 1 wherein a layer of the gelatino-silver halide emulsion is coated on both sides of a biaxially oriented and subcoated poly(ethylene terephthalate) film support.

7. Process of claim 6 wherein an abrasion layer of gelatin plus hardening agent is applied over each of the emulsion layers, thereby permitting migration of the hardening agent from the abrasion layer to the silver halide emulsion layer.

8. Process of claim 7 wherein said hardening agent is formaldehyde.

9. A process for the sensitization of a light-sensitive gelatino-silver halide emulsion prior to coating it upon a support, which comprises adding to the emulsion in the supply vessel in which the emulsion originates (1) a gold or sulfur sensitizer, followed by a cooling step, (2) glutaraldehyde bisulfite, in a concentration of between 0.05 and 0.3% by weight, based on the weight of total gelatin in the emulsion, and (3) the sodium salt of benzene sulfinic acid, in a concentration of 0.5 to 15 grams per mole of silver halide in the emulsion; pumping the resulting sensitized emulsion to a coater; preparing in a separate vessel a solution of gelatin and formaldehyde hardener, and pumping said solution to the coater; applying from the coater a continuous layer of the sensitized gelatino-silver halide emulsion to a support film; and then applying over the silver halide emulsion layer as an abrasion layer said gelatin solution containing formaldehyde hardener.

* * * * *